US007809323B2

(12) United States Patent
Johnston et al.

(10) Patent No.: US 7,809,323 B2
(45) Date of Patent: Oct. 5, 2010

(54) SDM AUTOMATIC CONTROL ALGORITHM

(75) Inventors: Daniel E. Johnston, Webster, NY (US); Thomas C. Keyes, Fairport, NY (US); Brian C. Cyr, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 736 days.

(21) Appl. No.: 11/696,411

(22) Filed: Apr. 4, 2007

(65) Prior Publication Data

US 2008/0247796 A1 Oct. 9, 2008

(51) Int. Cl.
*G03G 15/00* (2006.01)

(52) U.S. Cl. ..... 399/406; 399/397

(58) Field of Classification Search ..... 399/406, 399/397

See application file for complete search history.

(56) References Cited

U.S. PATENT DOCUMENTS 5,848,347 A * 12/1998 Kuo et al. ..... 399/406
6,259,888 B1 * 7/2001 Kazama et al. ..... 399/406
6,282,403 B1 * 8/2001 Spencer et al. ..... 399/406
7,062,218 B2 * 6/2006 Burnett et al. ..... 399/406
2005/0260005 A1 * 11/2005 Vanbortel et al. ..... 399/45
2006/0018694 A1 * 1/2006 Hayashi ..... 399/406

* cited by examiner

*Primary Examiner*—Anthony H. Nguyen
(74) *Attorney, Agent, or Firm*—Oliff & Berridge PLC

(57) ABSTRACT

A device, method and program for automatically adjusting a paper curl of media in an imaging device are provided. The imaging device includes a decurler having two rollers defining a nip. A first roller has a substantially uncompressible surface, and a second roller has a substantially compressible surface. The first roller penetrates the second roller at the nip. The amount of curl of the media is adjusted at the nip by automatically adjusting the penetration of the second roller into the first roller. The amount of penetration of the second roller into the first roller is based on a set of factors and conditions. A penetration value based on the factors and conditions is used to adjust the position of the first roller and the second roller respective to each other, which in turn, will alter or reduce the media curl to a target curl.

20 Claims, 3 Drawing Sheets

SDM AUTOMATIC CONTROL ALGORITHM

BACKGROUND

The exemplary embodiments are directed to imaging devices, and more particularly to the use of decurlers in imaging devices. Decurlers flatten media, such as, for example, paper in an imaging device. A decurler may be built into an imaging device and adjusted manually to appropriately decurl the media as needed. For example, a user may analyze output from an imaging device and then chance settings of the imaging device to obtain a desired curl. In the related art, users would open a housing of the imaging device to adjust the settings. In this regard, decurlers were manually set and users would turn off the imaging device and open a housing of the imaging device in order to adjust the imaging device. Alternatively, the settings may be adjusted by the user by inputting certain decurler parameters. The imaging device would need to be readjusted manually for different environments. The decurler settings of the related art are adjusted based on the appearance of the output.

SUMMARY

The exemplary embodiments are directed to an imaging device that automatically adjusts settings to obtain an appropriate or desired media curl. In an exemplary embodiment, a device and a method is provided for reducing paper curl of a media in an imaging device. The imaging device may include a decurler having two rollers defining a nip. The first roller may have a substantially uncompressible surface. The second roller may have a substantially compressible surface. The media may be transferred to the decurler after an image is produced thereon. At the decurler, the media may progress through the nip between the two rollers. The amount of curl induced to the media by the nip may be automatically adjusted by adjusting the amount of penetration of the first roller into the second roller. That is, pressure applied to the media by the rollers at the nip may act to further curl or decurl the media. Adjusting the relative position of the two rollers with respect to each other will adjust the amount of penetration of the first roller into the second roller. A penetration value may be used to quantify the penetration of the first roller into the second roller. How much, or how far to adjust the position of one or both of the rollers may be based on a plurality of factors.

In this regard, adjusting the relative position of the rollers may include assigning a value to every factor in a set of factors. The set of factors may include grains of water, relative humidity of the environment, simplex or duplex imaging, fuser temperature, short-edge feed or long-edge feed of the media, target curl, decurler mode, and/or other physical or environmental factors. Based on conditions of the media such as, for example, paper weight and paper coating, a group of factors may be selected.

In an exemplary embodiment the penetration value may be calculated based on the group of factors selected. A quadratic equation may be used to calculate the penetration value. Calculating the penetration value may include avoiding the use of imaginary values for the penetration value, where imaginary numbers contain "i" the square root of negative one. If the penetration value is imaginary when calculated using a quadratic equation, the calculating may include a linear equation instead. The calculating may also round the penetration value to the first decimal place, check to ensure the penetration value is reasonable, and make adjustments to the penetration value based on user input. Afterwards, the penetration value may be converted into a step value, where the step value is a value the imaging device can recognize. Finally, the imaging device may adjust the relative position of the roller anchor the second roller with respect to each other to obtain a desired curl of the media based on the step value.

BRIEF DESCRIPTION OF THE DRAWINGS

The exemplary embodiments will be further described with reference to the following drawings, wherein.

DETAILED DESCRIPTION OF EMBODIMENTS

Figure 1:
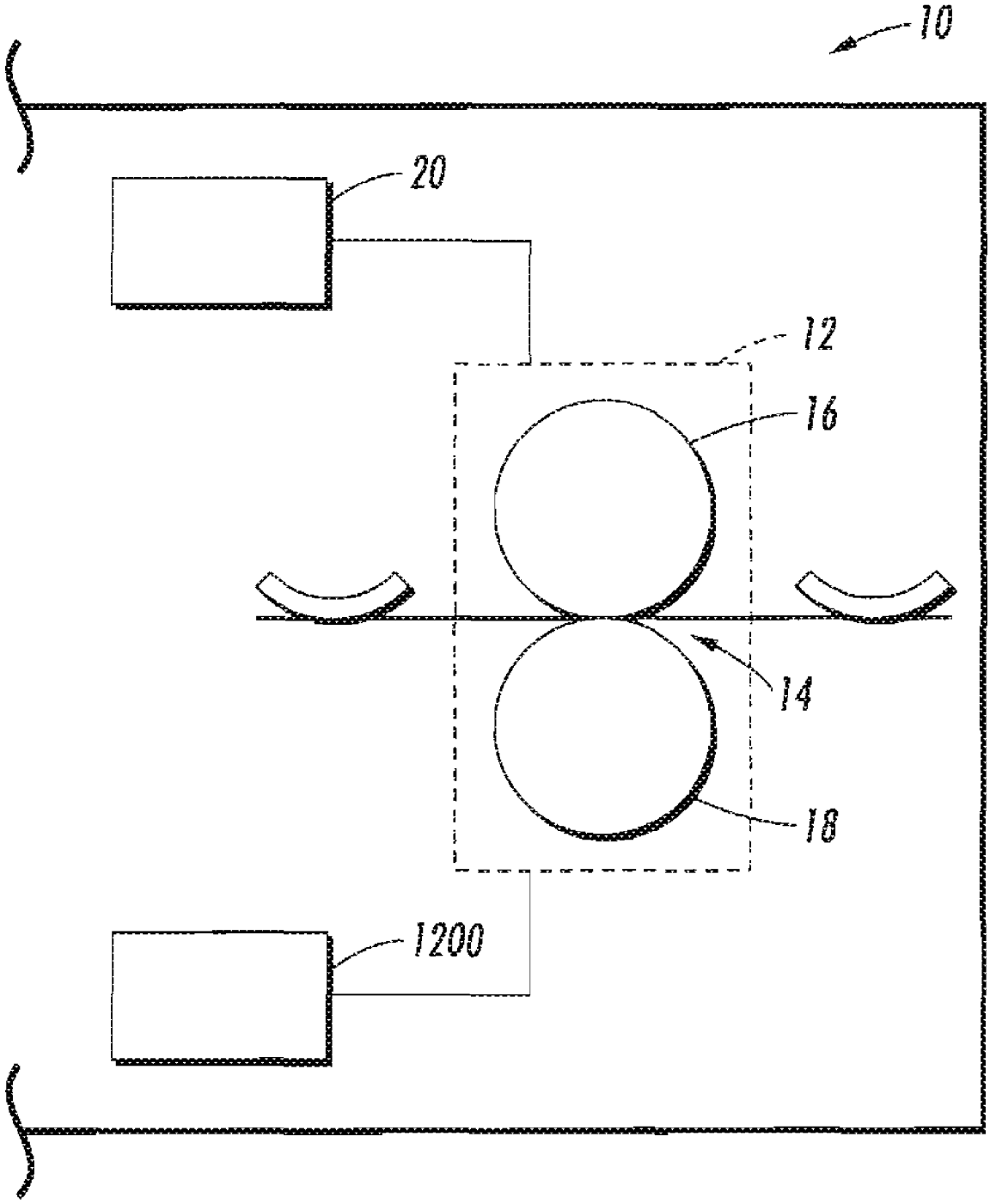
FIG. 1 illustrates an imaging device in an exemplary embodiment.

A problem which sometimes occurs in a printing machine such as an electrophotographic printing machine or other imaging devices, is the development of a curl or bend in the sheet as the sheet passes through the various processing stations.

A curled sheet may be undesirable from a variety of standpoints. For instance, the curled sheet may be difficult to handle as the sheet is processed in an imaging device. Curled sheets may produce jams or misfeeds within the imaging devices. Additionally, sheets having a curl or bend therein may be esthetically undesirable to consumers or users of the imaging device.

A decurler may take curl out of the sheet or other media or may induce additional curl, if desired. The decurler may have a compressible roller and a noncompressible roller that form a nip. The compressible roller may be, for example, a foam roller and the noncompressible roller may be, for example, a steel shaft. The steel shaft may be pushed against the foam roller. For example, the foam roller may be stationary, and the steel shaft may be pushed against the foam roller. In another exemplary embodiment, the steel shaft of the decurler may be stationary and the foam roll may be pushed into the shaft. The steel shaft may be stationary because the steel shaft is driven to maintain a constant paper speed. In another exemplary embodiment, the foam shaft may be stationary but the paper velocity may have more variation. In an exemplary embodiment, the centers of the shaft and roller are, for example, about 20 mm apart. Thus, for example, if the center-to-center distance between the rollers is 19 mm, then there would be a penetration value of 1 mm. That is, the steel shaft would penetrate the foam roller by approximately 1 mm. The amount of indentation into the foam determines the amount of decurling of the media, as the media passes through the nip defined by the steel shaft and foam roller.

Various numerical values will be used herein to describe the exemplary embodiments. Fore example, the above dimension of 20 mm was used to define the relative position of the shaft and roller. However, it should be understood that the values used herein are only exemplary and any values, without departing from the scope and spirit of the exemplary embodiments, including user determined or desired values, may be used.

An algorithm in an exemplary embodiment calculates the penetration value (i.e., the amount of penetration of the noncompressible roller into the compressible roller). For example, the penetration value would represent how much the steel shaft needs to be pushed into the foam roller to achieve a desired curl/decurl of the sheet so that the sheet obtains a target curl (i.e., a curl value acceptable, for example, to a user of the imaging device). The penetration value may ultimately be converted into a step value. A step value, as discussed herein, is a value used by the imaging device to represent the amount of curl/decurl to apply to a media.

Although the target curl may remain the same, the exemplary embodiments include an adjuster that may adjust parameters in an imaging device based on, for example, media parameters such as heavyweight paper stock, lightweight paper stock, coated paper, non-coated paper, etc.

Referring to the embodiment of FIG. 1, an imaging device 10 which includes reducing paper curl of a media is shown. The imaging device 10 may include a decurler 12 having two rollers defining a nip 14. A first roller 16 may have a substantially uncompressible surface. For example, the uncompressible surface may consist of steel or other hard materials. That is, the uncompressible surface may consist of any material that would not substantially deform when subjected to heat, pressure, or the like when used in connection with an imaging device. A second roller 18 may have a substantially compressible surface. For example, the compressible surface may consist of foam, or other like deformable material. The device 10 may include an adjustor 20 that adjusts the amount of curl induced at the nip 14 by automatically adjusting a relative position of the first roller 16 to the second roller 18 such that a penetration of the first roller into the second roller may be adjusted.

Figure 2:
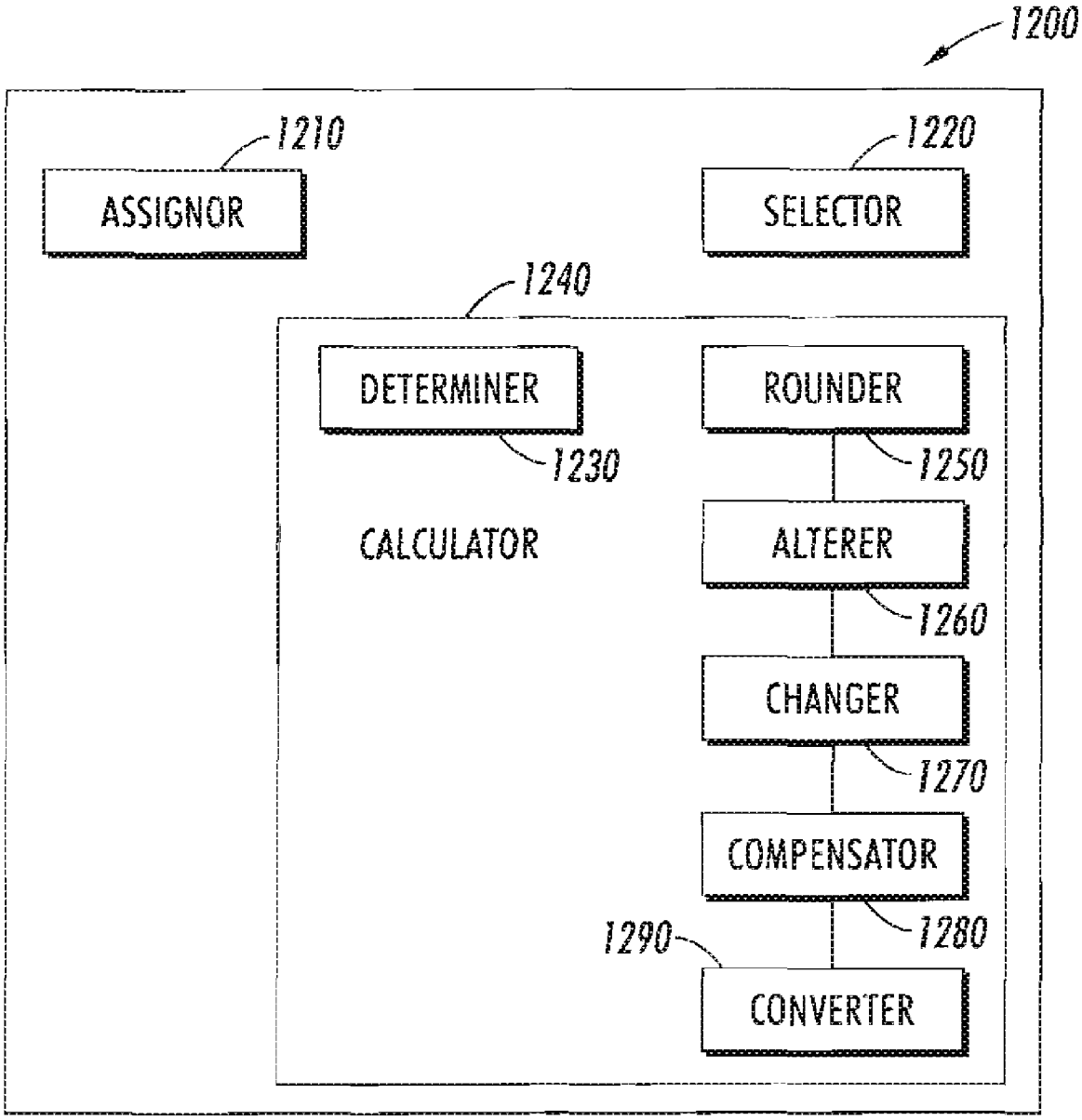
FIG. 2 illustrates an automatic decurler for imaging device in an exemplary embodiment.

The imaging device 10 may also contain a decurler interface module 1200. Referring to FIG. 2, the decurler interface module 1200 contains an assignor 1210, a selector 1220, a calculator 1240. The calculator contains a determiner 1230, a rounder 1250, an alterer 1260, a changer 1270, a compensator 1280, and a converter 1290.

The assignor 1210 assigns a value to each factor of the set of factors. For example, values may be assigned to grains of water, relative humidity of the environment, simplex or duplex imaging, fuser temperature, short-edge feed or long-edge feed of the media, a target curl, a decurler mode, and the like.

The selector 1220 may select a group of factors from the set of factors based on a set of conditions. In an exemplary embodiment, the set of factors is composed of different values for each factor, and each factor has a different value for each condition. For example, the conditions may include light weight paper, medium weight paper, heavy weight paper, coated paper, and the like.

The factors may be constant for an imaging device or the factors may be dynamically calculated based on the environment at a specific time in the imaging device. Some factors may change in value on a regular basis. Multiple values may be calculated for the factors for various paper weights and paper coating.

The decurler mode may be +1, if the sheet is not inverted or inverted twice. In an exemplary embodiment, if the sheet is inverted once, the curl direction is flipped over and the decurler mode is set to −1 so the sheet is put through the opposite decurler of normal operation.

In another exemplary embodiment, the decurler may have two decurler nips facing in opposite directions so curl can be driven both up and down. A change in the decurler mode may cause the media to go to the opposite decurler. For example, with 75 gsm paper and a simplex job face down, the method may calculate a penetration value of +0.4. In this example, the sheet goes to the upper decurler nip. If the job is programmed as face up, the sheet will come out of the decurler flipped. When simplex job face up is selected one inversion occurs and decurler mode is set to −1.0 changing the penetration value to −0.4. With a penetration value of less than zero, the lower decurler nip may be used. Two decurler nips in opposite directions allow the correction of curl regardless if the penetration value is positive or negative.

In an exemplary embodiment, each factor will have multiple values based on different conditions. The grains of water may be calculated from temperature and humidity measured in the image output terminal (IOT) of the imaging device. Based on the grains of water calculation, relative humidity in the environment can be determined. In simplex or duplex imaging, simplex refers to one-sided imaging and duplex refers to two-sided imaging. For example, if the copying is simplex, then the factor may be assigned a value of −1. If the copying is duplex, then the factor may be assigned a value of 1.

Fuser temperature refers to the temperature of the fuser in the imaging device. Long-edge feed is when the cross direction of the media is larger than the process direction. Short-edge feed is when the cross direction of the media is smaller than the process direction. Media weight may be input by a user of the imaging device, in terms of grams per square meter (GSM) or may be determined by a sensor or other known or later developed device. For example, lightweight paper may generally have a GSM of below 75, medium weight paper may generally have a paper weight of 75 GSM to 122 GSM, and heavy weight paper may have a weight of 123 GSM and higher. If a media has any type of coating, it is considered to be coated. Values may be assigned to the media based on the type and/or amount of coating.

In an exemplary embodiment, the different factors may be given priority over each other. For example, coated media may have priority over paper weight. In other words, a controller in the imaging device may select the values for the factors for coated media regardless of the weight of the media. Coating, weight, and orientation of the media may be input by a user or may be sensed and/or determined by a sensor or other known or later developed device.

Target curl is the nominal target flat curl that the automatic control will try to achieve. In an exemplary embodiment, the value for target curl is (−1 mm) of fiat curl. For a −1 mm of flat curl, when the media exits the imaging device it may be downcurled. For example, there will be a 1 mm difference between the lowest and the highest point of the media. The general range of target curl is between −6 mm to 4 mm where a positive value represents upcurl, and a negative value represents downcurl. In an exemplary embodiment, the range of target curl may be between of −1.0 mm to 1.0 mm. The target curl value is preset and may be changed.

The calculator 1240 contains a determiner 1230. The determiner 1230 determines if the penetration value is imaginary based on the group of factors. For example, values A, B and C may be calculated based on earlier discussed equations and the values may be based on the selected group of factors. The determiner 1230 determines if the penetration value will be imaginary using the A, B and C values. The determiner 1230 will use the equation B^2−4*A*C. If the equation returns a negative number then the determiner predicts that the penetration value will be imaginary. As a result, the calculator will avoid using the quadratic equation. In an exemplary embodiment, the calculator uses the following linear equation:

$$\text{Penetration}=-B/(2*A)*\text{Decurler Mode}.$$

However, if the equation returns a positive value, then the determiner 1230 determines that the penetration value will not be imaginary. In an exemplary embodiment, the calculator 1240 uses the following quadratic equation to calculate the penetration value:

$$\text{Penetration Value}=(B-\sqrt{(B\hat{}2-4*A*C)})/(2*A).$$

The calculator 1240 will send the penetration value to the rounder 1250 after the calculations have been completed.

The rounder 1250 rounds the penetration value to a predetermined increment. In an exemplary embodiment, the rounder rounds the penetration value to the nearest 0.1 mm value. Then the rounder 1250 may send the rounded penetration value to the alterer 1260. The alterer 1260 may determine if the penetration value is valid. For example, if the penetration value is greater than the target absolute value of, for example, 1.0 mm, then the alterer 1260 will adjust the penetration value accordingly. In an exemplary embodiment, if the penetration value is greater than, for example, 1.0 mm then the alterer 1260 will reduce the penetration value to 1.0 mm. If the penetration value is less than −1.0 mm, for example, then the alterer will set the penetration value to −1.0 mm. Then the alterer 1260 may send the penetration value to the changer 1270.

The changer 1270 changes the penetration value based on a user input. In an exemplary embodiment, the user input usually takes the form of a slider value where the slider value has a value of, for example, between −3 and 3. However, the changer 1270 does not change the penetration value if the slider value is zero. The changer 1270 then sends the penetration value to the compensator 1280.

The compensator 1280 determines if the penetration value is invalid, that is, if the penetration value falls outside of a predetermined acceptable range. In an exemplary embodiment, for example, the penetration value may be invalid if the value is between −0.1 mm and 0.1 mm. In this case, the penetration value will compensate the penetration value based on an offset value. The compensator 1280 then sends the penetration value to the converter 1290. The converter 11290 converts the penetration value into a step value. The step value converts the penetration value into a number that the imaging device can recognize. The step value is then sent out of the decurler interface module 1200 to the decurler where the decurler will then apply the step value to a sheet of paper removing the curl based on the target FlatCurl value.

Figure 3:
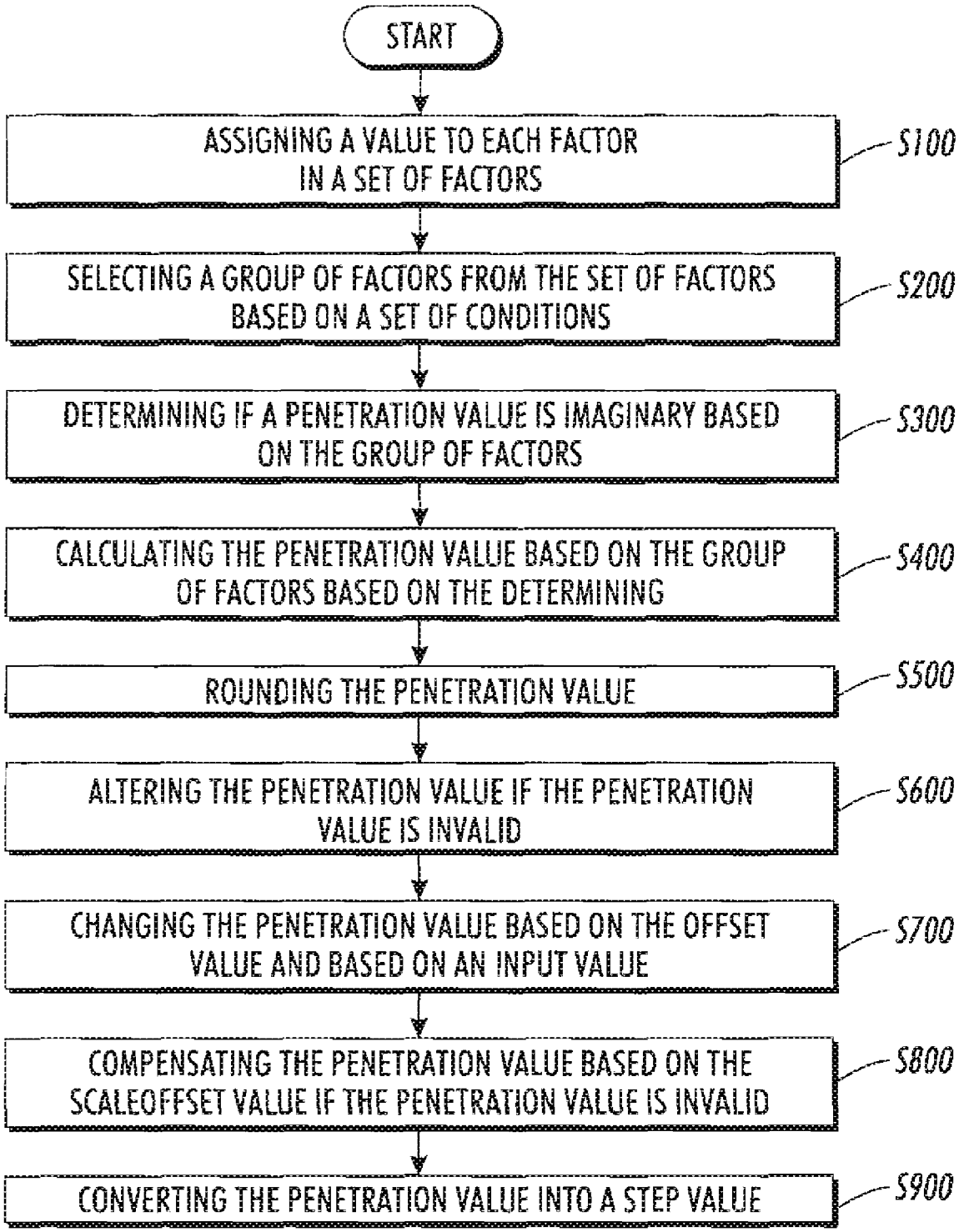
FIG. 3 illustrates a method of decurling media in an imaging device in an exemplary embodiment.

Referring to the embodiment of FIG. 3, a flowchart illustrating a method for decurling media in an imaging device is illustrated in which the imaging device includes two rollers defining a nip, a first roller having a substantially uncompressible surface and a second roller having a substantially compressible surface. As discussed above, media may pass between the rollers and the distance between a center axis of the rollers may be adjusted to affect the amount of pressure applied to the media to curl/decurl the media between the two rollers. Other factors of the media, imaging device and/or environment may affect the distance the rollers must travel to achieve the target curl. The decurler mode allows the imaging device to reverse the path of the media during the imaging process. For example, if a single inversion is performed, the sign of target curl in the decurler direction must be reversed. This variable depends on simplex or duplex imaging, face up or down and curl reduction mode. It is set by user diagnostics and job settings. If the value of an input factor is outside the lower preset limit or upper preset limit allowed by the system, the system will move the value to the closest limit. If a value lies outside the preset limits allowed to be used, the penetration control equation may yield unreasonable results.

The factors are all assigned a value either determined by sensors on the machine or determined from a preprogrammed value based on user input, as shown at S100. The preprogrammed value varies from imaging device to imaging device.

A group of factors from the set of factors based on a set of conditions is chosen as shown at S200. In other words, a single value may be selected for each factor after the conditions are determined. Each factor may have multiple values for the different paper weights or paper coatings, one value for each condition. The values are also based on target flat curl value. After a value is assigned to every factor in the set of factors and after the conditions are determined, a group of factors is chosen. In an exemplary embodiment, the conditions may depend on, for example, whether the paper is heavy paper weight, medium paper weight, light paper weight, or coated paper. The group of factors may consist of a constant) relative humidity, simplex or duplex imaging, fuser temperature, penetration value, short edge feed or long edge feed, fuser temperature^2, and penetration^2. Also the values assigned may be based on a flat curl value. The flat curl value is the default target curl value. For example, the flat curl value is not always zero due to customer preference. The flat curl value is determined by a technician and preprogrammed into the imaging device.

Next, all calculations are checked to ensure real values are returned as shown at S300. Since the calculations may be based on the quadratic formula, pre-calculations are made to ensure an imaginary value is not returned. Based on the set of factors selected, a determination may be made as to whether the penetration value will be imaginary based on the values of the group of factors selected based on the conditions. Based on the A, B and the C values, which is derived from the group of factors, a determination is made as to whether the penetration value will be imaginary. Ln an exemplary embodiment, the A, B and C coefficients are based on a regression set of curl data from previously designed experiments. For example:

$$A = \text{NVM_PENETRATIONSQ_MD_54_3};$$

$$B = \text{NVM_PENETRATION_MD_54_3; and}$$

$$\begin{aligned} C = {} & \text{NVM_CONST_MD_54_3} + \\ & \text{NVM_RH_MD_54_3} * RH + \text{NVM_PLEX_MD_54_3} * Plex + \\ & \text{NVM_FUSER_TEMP_MD_54_3} * \text{Fuser_Temp} + \\ & \text{NVM_SEF_LEF_MD_54_3} * \text{SEF_LEF} + \\ & \text{NVM_PAPERWEIGHT_MD_54_3} * PaperWeight + \\ & \text{NVM_FUSER_TEMPSQ_MD_54_3} * \text{Fuser_Temp} \wedge 2 - \\ & \text{NVM_DIMTARGETCURL_MD_54_3} * DecurlerMode. \end{aligned}$$

If the value for B^2 is less than 4*A*C then the penetration value will be imaginary based on the quadratic equation. In other words, because the square root of a negative number leads to an imaginary value, when the penetration value is predicted to be imaginary, a non-quadratic equation must be used to calculate the penetration value. In such a case, a linear equation will be used.

To prevent the use of imaginary values, the penetration value is evaluated to determine if it is imaginary. Calculating a penetration value based on the group of factors and also based on the determination of whether the penetration value is imaginary is shown at S400. If the penetration value is imaginary based on the B^2−4*A*C equation described above, then a non-quadratic equation must be used. In an exemplary embodiment, as an alternative, the penetration value may be calculated using a linear equation. For example, penetration value may be calculated using:

$$\text{Penetration}=-B/(2*A)*\text{Decurler Mode}.$$

However, if it is determined that the penetration value is not imaginary, then the penetration value equation shown below based on the quadratic equation, example, is used. In an exemplary embodiment, the penetration value is calculated using the A, B and C values composed of the group of values using:

$$\text{Penetration Value}=(B-\sqrt{(B\hat{}2-4*A*C)})/(2*A).$$

In an exemplary embodiment, the equations used to calculate the A, B and C values are derived from the FlatCurl equation below. The FlatCurl may default, for example to −1 mm, but its value may be adjusted. As a result, penetration value changes accordingly as the FlatCurl value changes. This penetration value is based on the quadratic equation derived from the following FlatCurl equation:

$$\begin{aligned}FlatCurl = {} & \text{NVM_CONST_MD_54_3} + \\ & \text{NVM_RHMD_54_3} * RH + \text{NVM_PLEX_MD_54_3} * Plex + \\ & \text{NVM_FUSER_TEMP_MD_54_3} * \text{Fuser_Temp} + \\ & \text{NVM_PENETRATION_MD_54_3} * \text{Penetration} + \\ & \text{NVM_SEF_LEF_MD_54_3} * \text{SEF_LEF} + \\ & \text{NVM_PAPERWEIGHT_MD_54_3} * PaperWeight + \\ & \text{NVM_FUSER_TEMPSQ_MD_54_3} * \text{Fuser_Temp} \wedge 2 + \\ & \text{NVM_PENETRATIONSQ_MD_54_3} * \text{Penetration} \wedge 2.\end{aligned}$$

After the penetration value has been calculated then the method rounds the penetration value is rounded as shown at S500. In an exemplary embodiment, the penetration value may be rounded to the nearest 0.1 mm. The penetration value may be rounded to the nearest 0.1 nun increment using the following function:

$$\text{AlgorithmPenetration}=\text{Round}(\text{Penetration}, 1).$$

In an exemplary embodiment, the 1 sent to the Round function indicates that the penetration value should be rounded to the first decimal place. Alternatively, any desired increment may be used.

The penetration value may be checked to determine if the penetration value is invalid, as shown at S600. For example, if the penetration value after rounding is −0.1 mm, 0 or 0.1 mm, then the penetration value is set to 0.2 mm with the same sign as the penetration number. Also, if the penetration value is larger than 1.0 mm or less than −1.0 mm, then the penetration value is set to 1.0 mm with the penetration sign the same as the penetration value. This ensures that the penetration value is between −1.0 nm and 1.0 mm, if such a range is desired. Of course, the same process may be used for any desired range of curl, and the above values are intended to be exemplary.

The penetration value may be adjusted based on user input value, as shown at S700. Here if desired, user input may be utilized. For example, an end user may override imaging device defaults by manually inputting the desired curl offset. Users may set the decurler to provide more upcurl or downcurl. Users may input to the decurler an offset penetration value and have it applied to all paper types. In an exemplary embodiment, the user inputs an offset value with a slider. The slider may input a number from, for example, −3 to +3 range in whole number increments including 0. The algorithm may read the input value from the slider. If the slider value is not equal to zero, then the algorithm may adjust the value using the following equation:

$$\text{FinalPenetration}=\text{IntermediatePenetration}+\text{ScaleOffset}*(\text{Slider Value}/ABS(\text{Slider Value})).$$

If the slider value is equal to 0, then the system may use the following equation:

$$\text{FinalPenetration}=\text{IntermediatePenetration}.$$

In other words, in this exemplary embodiment, no adjustment to the curl of the output media is made via user input.

A ScaleOffset term may be included to compensate for invalid penetration values as shown at S800. For example, if the user adjustment would cause the penetration value to be invalid or the decurler direction to change then the appropriate millimeters must be added or subtracted from the IntermediatePenetration value. In an exemplary embodiment, the following logic is used to determine the scale offset value:

(1) If AlgorithmPenetration>0.1 and IntermediatePenetration≦0.1 then ScaleOffset=0.3; or (2) if AlgorithmPenetration<−0.1 and IntermediatePenetration≧−0.1 then ScaleOffset=0.3; or (3) For all other conditions, the ScaleOffset is equal to 0.

The logic determines if the IntermediatePenetration is at or below, for example, 0.1 mm when the AlgorithmPenetration is above 0.1 mm and for the same conditions for a negative AlgorithmPenetration. When these conditions are fulfilled then the ScaleOffset may need to be applied. If these conditions do not exist then the ScaleOffset is not required. The IntermediatePenetration value is evaluated to determine if it is, for example, greater than 1.0 mm or less than −1.0 mm and if it is then the IntermediatePenetration value will be set to a value of 1.0 mm and the IntermediatePenetration sign will remain the same as also shown at S800.

The penetration value may be converted to a step value as shown at S900. The penetration value represents the distance as to how much the media needs to be decurled. The step value represents how much the decurler of the imaging device must adjust to decurl the paper based on the penetration value. In an exemplary embodiment, there are different equations for calculating step value, which are based on whether the media has upcurl or downcurl. If the penetration value is positive then the method uses the following equation:

$$\text{Steps}=NVM_\text{UPPERCAMMAXSTEPCOUNT}_MD_54_3+\text{Integer}\ (-26.117*\text{Final Penetration}\hat{}2-62.135*\text{FinalPenetration}+90.959,0).$$

If the sign of FinalPenetration is negative, the method will use the following equation for lower decurler steps:

$$\text{Steps}=NVM_\text{LOWERCAMMAXSTEPCOUNT}_MD_54_3+\text{Integer}\ (44.501*\text{Final Penetration}\hat{}2-43.803*\text{FinalPenetration}-90.198, 0).$$

Step value can be calculated anytime the machine is operating. Preferably, the step value is recalculated after each media passes through.

The system takes the step value and then physically applies it to decurl the paper. The decurling takes place based on the step value. The substantially uncompressible roller is driven into the substantially compressible roller a distance based on the step value. The media then passes through the rollers and decurls an amount based on the target flat curl and a group of factors based on the device.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for reducing curl of a media in an imaging device, the imaging device including a decurler having two rollers defining a nip, a first roller having a substantially uncompressible surface, and a second roller having a substantially compressible surface, the method comprising:

adjusting an amount of curl of the media induced by the nip by automatically adjusting a penetration of the second roller into the first roller, wherein the adjusting includes:

assigning a value to each factor in a set of factors;

selecting a group of factors from the set of factors based on a set of conditions;

calculating a penetration value based on the group of factors, the adjusting of the penetration of the second roller into the first roller being performed based on the penetration value; and determining if the penetration value is imaginary based on the group of factors, wherein under the condition that the penetration value is imaginary, the calculating of the penetration value is based on a first equation, and under the condition that the penetration value is not imaginary, the calculating of the penetration value is based on a second equation.

2. The method of claim 1, wherein the group of factors include at least two of relative humidity, simplex or duplex imaging, fuser temp, long-edge feed or short-edge feed, area of coverage distribution, paper loading direction, target curl, and decurler mode, and wherein the set of conditions includes media weight and media coating.

3. The method of claim 1, wherein the group of factors includes A, B and C, and the penetration value is imaginary under the condition that $B^2<4*A*C$, and the penetration value is not imaginary under the condition that $B^2\geqq 4*A*C$.

4. The method of claim 1, wherein the penetration value is based on an user input value.

5. The method of claim 1, wherein the calculating includes varying the penetration value based on a scaleoffset value if the penetration value is invalid.

6. The method of claim 1, wherein an amount of curl is between 4 mm of upcurl to 6 mm of downcurl.

7. The method of claim 1, wherein an amount of curl is between 1 mm of upcurl to 1 mm of downcurl.

8. An imaging device for reducing curl of a media, the imaging device comprising:

a decurler having two rollers defining a nip;

a first roller having a substantially uncompressible surface;

a second roller having a substantially compressible surface; and an adjustor to adjust an amount of curl of the media induced by the nip by automatically adjusting a penetration of the first roller into the second roller, wherein the adjustor includes:

an assignor to assign a value to each factor in a set of factors;

a selector to select a group of factors from the set of factors based on a set of conditions;

a calculator to calculate a penetration value based on the group of factors, wherein the adjustor adjusts the penetration of the second roller into the first roller based on the penetration value; and a determiner to determine if the penetration value is imaginary based on the group of factors, wherein under the condition that the penetration value is imaginary, the calculating of the penetration value is based on a first equation, and under the condition that the penetration value is not imaginary, the calculating of the penetration value is based on a second equation.

9. The device of claim 8, wherein the group of factors includes at least two of relative humidity, simplex or duplex imaging, fuser temp, long edge feed or short edge feed, area coverage distribution, paper loading direction, target curl, and decurler mode, and wherein the set of conditions includes media weight and media coating.

10. The device of claim 8, wherein the group of factors includes A, B and C, and the penetration value is imaginary under the condition that $B^2<4*A*C$, and the penetration value is not imaginary under the condition that $B^2\geqq 4*A*C$.

11. The device of claim 8, wherein the penetration value is based on an user input value.

12. The device of claim 8, wherein the calculator includes a compensator to varying the penetration value based on a scaleoffset value if the penetration value is invalid.

13. The device of claim 8, wherein an amount of curl is between 4 mm of upcurl and 6 mm of downcurl.

14. The device of claim 8, wherein an amount of curl is between 1 mm of upcurl and 1 mm of downcurl.

15. A system for reducing curl of a media in an imaging device, the imaging device including a decurler have two rollers defining a nip, a first roller having a substantially uncompressible surface, and a second roller having a substantially compressible surface, the system comprising:

a means for adjusting an amount of curl of the media induced by the nip by automatically adjusting a penetration of the first roller into the second roller, wherein the means for adjusting includes:

a means for assigning a value to each factor in a set of factors;

a means for selecting a group of factors from the set of factors based on a set of conditions;

a means for calculating a penetration value based on the group of factors, the adjusting of the penetration of the second roller into the first roller being performed based on the penetration value; and a means for determining if the penetration value is imaginary based on the group of factors, wherein under the condition that the penetration value is imaginary, the calculating of the penetration value is based on a first equation, and under the condition that the penetration value is not imaginary, the calculating of the penetration value is based on a second equation.

16. A program embodied on a non-transitory computer readable medium for reducing curl of media in an imaging device, the imaging device including a decurler have two rollers defining a nip, a first roller having a substantially uncompressible surface, and a second roller having a substantially compressible surface, the program causing a controller to perform the method of claim 1.

17. The method of claim 3, wherein the first equation is defined by penetration value=−B/(2*A)*Decurler Mode, wherein Decurler Mode=1 under the condition that the media is not inverted or inverted twice and Decurler Mode=−1 under the condition that the media is inverted, and the second equation is defined by penetration value=B−((B^2−4*A*C)^(½))/(2*A).

18. The device of claim 10, wherein the first equation is defined by penetration value=−B/(2*A)*Decurler Mode, wherein Decurler Mode=1 under the condition that the media is not inverted or inverted twice and Decurler Mode=−1 under the condition that the media is inverted, and the second equation is defined by penetration value=B−((B^2−4*A*C)^(½))/(2*A).

19. The system of claim 15, wherein the group of factors includes A, B and C, and the penetration value is imaginary under the condition that B^2<4*A*C, and the penetration value is not imaginary under the condition that B^2≧4*A*C.

20. The system of claim 19, wherein the first equation is defined by penetration value=−B/(2*A)*Decurler Mode, wherein Decurler Mode=1 under the condition that the media is not inverted or inverted twice and Decurler Mode=−1 under the condition that the media is inverted, and the second equation is defined by penetration value=B−((B^2−4*A*C)^(½))/(2*A).

* * * * *

UNITED STATES PATENT AND TRADEMARK OFFICE

CERTIFICATE OF CORRECTION

PATENT NO. : 7,809,323 B2
APPLICATION NO. : 11/696411
DATED : October 5, 2010
INVENTOR(S) : Donald E. Johnston et al.

It is certified that error appears in the above-identified patent and that said Letters Patent is hereby corrected as shown below:

Title Page
Please delete the following:

"(75) Inventors: Daniel E. Johnston, Webster, NY (US);
Thomas C. Keyes, Fairport, NY (US);
Brian C, Cyr, Penfield, NY (US)"

and replace with:

(75) Inventors: Donald E. Johnston, Webster, NY (US);
Thomas C. Keyes, Fairport, NY (US);
Brian C. Cyr, Penfield, NY (US)

Signed and Sealed this

Thirtieth Day of November, 2010

David J. Kappos

David J. Kappos
*Director of the United States Patent and Trademark Office*